US011230939B2

(12) United States Patent
Rogers et al.

(10) Patent No.: US 11,230,939 B2
(45) Date of Patent: Jan. 25, 2022

(54) VANE SEAL SYSTEM AND SEAL THEREFOR

(71) Applicant: Raytheon Technologies Corporation, Farmington, CT (US)

(72) Inventors: Mark J. Rogers, Kennebunk, ME (US); Carl S. Richardson, South Berwick, ME (US); Richard K. Hayford, Cape Neddick, ME (US); Kenneth E. Carman, Kennebunk, ME (US); Jonathan J. Earl, Wells, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/989,441

(22) Filed: Aug. 10, 2020

(65) Prior Publication Data

US 2021/0108530 A1 Apr. 15, 2021

Related U.S. Application Data

(63) Continuation of application No. 15/026,709, filed as application No. PCT/US2014/054740 on Sep. 9, 2014, now Pat. No. 10,808,563.
(Continued)

(51) Int. Cl.
*F01D 11/00* (2006.01)
*F01D 11/08* (2006.01)
(Continued)

(52) U.S. Cl.
CPC ..... *F01D 11/005* (2013.01); *F01D 11/001* (2013.01); *F01D 11/08* (2013.01);
(Continued)

(58) Field of Classification Search
CPC ..... F01D 11/005; F01D 9/041; F01D 11/001; F01D 11/08; F01D 25/04; F05D 2220/32; F05D 2260/52
See application file for complete search history.

(56) References Cited

U.S. PATENT DOCUMENTS 4,285,633 A * 8/1981 Jones ..... F01D 11/001 415/191
4,645,424 A 2/1987 Peters
(Continued)

FOREIGN PATENT DOCUMENTS

WO 2013115874 8/2013

OTHER PUBLICATIONS

The International Search Report and Written Opinion for PCT Application No. PCT/US2014/054740, dated Jun. 18, 2015.
(Continued)

*Primary Examiner* — Aaron R Eastman
(74) *Attorney, Agent, or Firm* — Carlson, Gaskey & Olds, P.C.

(57) ABSTRACT

A vane seal system includes a first non-rotatable vane segment that has a first airfoil with a first pocket at one end thereof. A second non-rotatable vane segment includes a second airfoil with a second pocket at one end thereof spaced by a gap from the first pocket. A seal member spans across the gap and extends in the first pocket and the second pocket. The seal member includes a seal element and at least one spring portion configured to positively locate the seal member in a sealing direction. Also disclosed is a seal for a vane seal system and a method related thereto for damping relative movement between a first pocket and a second pocket.

20 Claims, 2 Drawing Sheets

Related U.S. Application Data

(60) Provisional application No. 61/886,223, filed on Oct. 3, 2013.

(51) Int. Cl.
*F01D 25/04* (2006.01)
*F01D 9/04* (2006.01)

(52) U.S. Cl.
CPC ..... *F01D 25/04* (2013.01); *F01D 9/041* (2013.01); *F05D 2220/32* (2013.01); *F05D 2260/52* (2013.01)

(56) References Cited

U.S. PATENT DOCUMENTS

| | | | |
|---|---|---|---|
| 4,767,267 | A | 8/1988 | Salt et al. |
| 5,715,596 | A | 2/1998 | Bintz |
| 5,785,492 | A | 7/1998 | Belsom et al. |
| 6,042,334 | A | 3/2000 | Schilling |
| 6,139,264 | A | 10/2000 | Schilling |
| 2006/0133928 | A1 | 6/2006 | Bracken et al. |
| 2007/0258826 | A1 | 11/2007 | Bracken et al. |
| 2008/0019836 | A1 | 1/2008 | Butz et al. |
| 2011/0142651 | A1 | 6/2011 | Lhoest |
| 2012/0177485 | A1 | 6/2012 | Virkler et al. |
| 2013/0000324 | A1 | 1/2013 | Alvanos et al. |
| 2013/0045088 | A1 | 2/2013 | Baumann |
| 2013/0045089 | A1 | 2/2013 | Bridges et al. |
| 2013/0119617 | A1 | 5/2013 | Alvanos et al. |
| 2013/0168927 | A1 | 6/2013 | Simpson |
| 2014/0050564 | A1 | 2/2014 | Hagan |

OTHER PUBLICATIONS

Supplementary European Search Report for European Patent Application No. 14864145 completed Jun. 30, 2017.
International Preliminary Report on Patentability for PCT Application No. PCT/US2014/054740 completed on Apr. 19, 2016.
European Search Report for European Patent Application No. 19150273.1 dated Apr. 10, 2019.

* cited by examiner

VANE SEAL SYSTEM AND SEAL THEREFOR

CROSS-REFERENCE TO RELATED APPLICATIONS

This application is a continuation of U.S. Ser. No. 15/026,709, filed Apr. 1, 2016, which is an application filed under 35 U.S.C. § 317 of Application No. PCT/US2014/054740, filed Sep. 9, 2014, which claims priority to U.S. Ser. No. 61/886,223 filed Oct. 3, 2013, all of which are hereby incorporated herein by reference in their entireties.

STATEMENT REGARDING GOVERNMENT SUPPORT

This invention was made with government support under contract number FA8650-09-D-2923 awarded by the United States Air Force. The government has certain rights in the invention.

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device, such as an epicyclical gear assembly, may be utilized to drive the fan section such that the fan section may rotate at a speed different than the turbine section. In such engine architectures, a shaft driven by one of the turbine sections provides an input to the epicyclical gear assembly that drives the fan section at a reduced speed.

SUMMARY

A vane seal system according to an example of the present disclosure includes a first non-rotatable vane segment including a first airfoil having at one end thereof a first pocket. A second non-rotatable vane segment includes a second airfoil having at one end thereof a second pocket spaced by a gap from the first pocket. A seal member spans across the gap and extends in the first pocket and the second pocket. The seal member includes a seal element and at least one spring portion configured to positively locate the seal member in a sealing direction.

In a further embodiment of any of the foregoing embodiments, the at least one spring portion is in frictional contact with sides of the first pocket and the second pocket such that the at least one spring portion damps relative movement between the first pocket and the second pocket.

In a further embodiment of any of the foregoing embodiments, the seal element is configured to seal against a mating rotatable seal element and the at least one spring portion is configured to positively locate the seal element toward the mating rotatable seal element.

In a further embodiment of any of the foregoing embodiments, the at least one spring portion is rigidly affixed with the seal element.

In a further embodiment of any of the foregoing embodiments, the at least one spring portion includes a first spring portion configured to bias the seal member in a first direction and a second seal portion configured to bias the seal member in a second, different direction.

In a further embodiment of any of the foregoing embodiments, the first direction and the second direction are orthogonal.

In a further embodiment of any of the foregoing embodiments, the at least one spring portion includes a spring leg.

In a further embodiment of any of the foregoing embodiments, the seal member includes a base wall having a first side and a second, opposed side, with a spring leg at one end of the base wall that extends from the first side, and the seal element is bonded to the first side.

In a further embodiment of any of the foregoing embodiments, the seal member includes a base wall with a first spring leg at one end thereof and a second spring leg at an opposed end thereof.

In a further embodiment of any of the foregoing embodiments, the first spring leg and the second spring leg bias the seal member in different directions.

In a further embodiment of any of the foregoing embodiments, the seal element includes a porous structure.

In a further embodiment of any of the foregoing embodiments, the seal member includes a uniform thickness base wall and the seal element extends from one side thereof.

In a further embodiment of any of the foregoing embodiments, the first pocket and the second pocket open laterally to each other and have respective open sides opening in a direction away from the respective first airfoil and second airfoil.

A seal for a vane seal system according to an example of the present disclosure includes a seal member configured to be received in a pocket at one end of an airfoil of a non-rotatable vane segment. The seal member includes a seal element configured to seal against a mating rotatable seal element and at least one spring portion affixed to the seal element and configured to positively locate the seal element in a sealing direction.

In a further embodiment of any of the foregoing embodiments, the at least one spring portion is rigidly bonded with the seal element.

In a further embodiment of any of the foregoing embodiments, the at least one spring portion includes a first spring portion configured to bias the seal member in a first direction and a second spring portion configured to bias the seal member in a second, different direction.

In a further embodiment of any of the foregoing embodiments, the at least one spring portion includes a spring leg.

In a further embodiment of any of the foregoing embodiments, the seal member includes a base wall having a first side and a second, opposed side, with a spring leg at one end of the base wall extending from the first side, and the seal element is bonded to the first side.

In a further embodiment of any of the foregoing embodiments, the seal member includes a base wall with a first spring leg at one end thereof and a second spring leg at an opposed end thereof.

A method for managing damping in a vane seal system according to an example of the present disclosure includes damping relative movement between a first pocket at an end of a first airfoil of a first non-rotatable vane segment and a second pocket at an end of a second airfoil of a second non-rotatable vane segment using a seal member that frictionally contacts sides of the first pocket and the second pocket.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
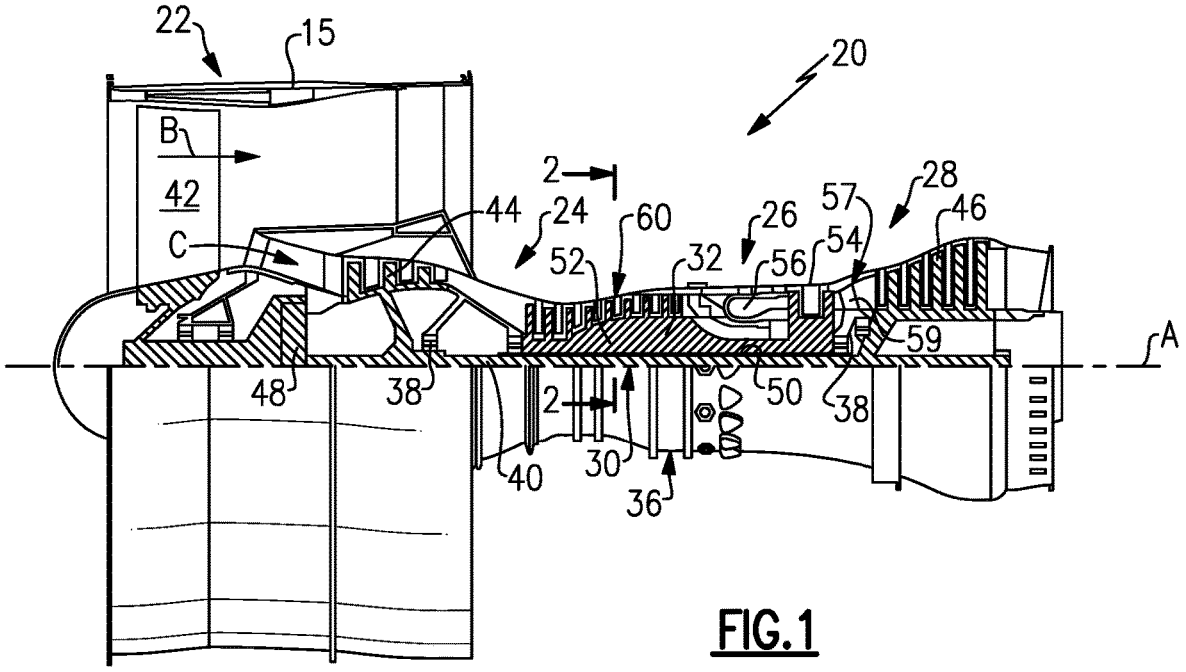
FIG. 1 illustrates an example gas turbine engine.

FIG. 1 schematically illustrates a gas turbine engine 20. The gas turbine engine 20 is disclosed herein as a two-spool turbofan that incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it is to be understood that the concepts described herein are not limited to use with two-spool turbofans and the teachings can be applied to other types of turbine engines, including three-spool architectures.

The engine 20 includes a low speed spool 30 and a high speed spool 32 mounted for rotation about an engine central axis A relative to an engine static structure 36 via several bearing systems, shown at 38. It is to be understood that various bearing systems at various locations may alternatively or additionally be provided, and the location of bearing systems may be varied as appropriate to the application.

The low speed spool 30 includes an inner shaft 40 that interconnects a fan 42, a low pressure compressor 44 and a low pressure turbine 46. The inner shaft 40 is connected to the fan 42 through a speed change mechanism, which in this example is a gear system 48, to drive the fan 42 at a lower speed than the low speed spool 30. The high speed spool 32 includes an outer shaft 50 that interconnects a high pressure compressor 52 and high pressure turbine 54.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A combustor 56 is arranged between the high pressure compressor 52 and the high pressure turbine 54. A mid-turbine frame 57 of the engine static structure 36 is arranged between the high pressure turbine 54 and the low pressure turbine 46. The mid-turbine frame 57 further supports bearing system 38 in the turbine section 28. The inner shaft 40 and the outer shaft 50 are concentric and rotate via, for example, bearing systems 38 about the engine central axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and gear system 48 can be varied. For example, gear system 48 may be located aft of combustor section 26 or even aft of turbine section 28, and fan section 22 may be positioned forward or aft of the location of gear system 48.

The engine 20 in one example is a high-bypass geared engine. In a further example, the engine 20 has a bypass ratio that is greater than about six (6), with an example embodiment being greater than about ten (10), the gear system 48 is an epicyclic gear train, such as a planet or star gear system, with a gear reduction ratio of greater than about 2.3, and the low pressure turbine 46 has a pressure ratio that is greater than about five (5). In one disclosed embodiment, the bypass ratio is greater than about ten (10:1), the fan diameter is significantly larger than that of the low pressure compressor 44, and the low pressure turbine 46 has a pressure ratio that is greater than about five (5). Low pressure turbine 46 pressure ratio is pressure measured prior to inlet of low pressure turbine 46 as related to the pressure at the outlet of the low pressure turbine 46 prior to an exhaust nozzle. The gear system 48 can be an epicycle gear train, such as a planet or star gear system, with a gear reduction ratio of greater than about 2.3:1. It is to be understood, however, that the above parameters are only exemplary and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ("TSFC")"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second.

The fan 42, in one non-limiting embodiment, includes less than about twenty-six fan blades. In another non-limiting embodiment, the fan section 22 includes less than about twenty fan blades. Moreover, in a further example, the low pressure turbine 46 includes no more than about six turbine rotors. In another non-limiting example, the low pressure turbine 46 includes about three turbine rotors. A ratio between the number of fan blades and the number of low pressure turbine rotors is between about 3.3 and about 8.6.

The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Various sections of the engine 20 can include one or more stages of circumferentially-arranged, non-rotatable stator vanes and rotatable blades. For example, the high pressure compressor 52 can include one or more of such stages. Although the examples herein may be described with respect to the high pressure compressor 52, it is to be understood that this disclosure is not limited to the high pressure compressor 52 and that the low pressure compressor 44 and the sections of the turbine 28 can also benefit from the examples herein.

Figure 2:
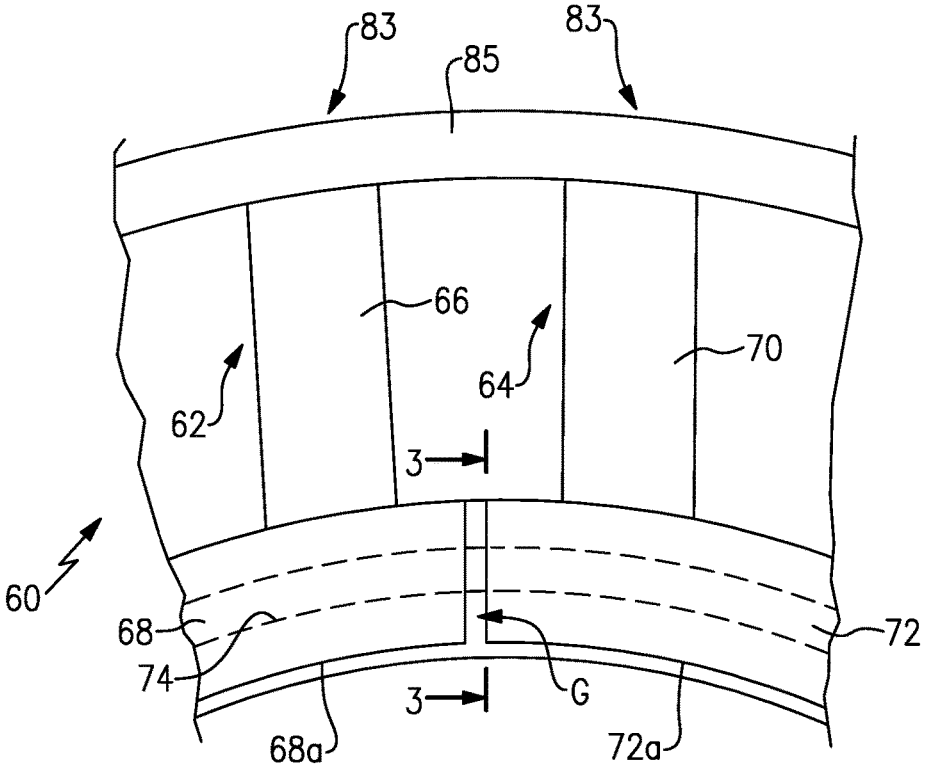
FIG. 2 illustrates an example vane seal system of the gas turbine engine of FIG. 2.

In this example, the high pressure compressor 52 includes one or more vane seal systems 60 (shown schematically), which is shown in isolated view in FIG. 2. The vane seal system 60 includes a first non-rotatable vane segment 62 and a second, circumferentially adjacent non-rotatable vane segment 64. The first non-rotatable vane segment 62 includes a first airfoil 66 having at one end thereof a first pocket 68. Similarly, the second non-rotatable vane segment 64 includes a second airfoil 70 having at one end thereof a second pocket 72 spaced by a gap, G, from the first pocket 68. The size of the gap is exaggerated in the illustration for purposes of description. The pockets 68/72 are at radially inward ends of the airfoils 66/70, relative to engine central axis A. In a modified example, the pockets 68/72 could alternatively be at the radially outer end of the airfoils 66/70. The pockets 68/72 open laterally (circumferentially) to each other and also open radially inwards at open sides 68*a*/72*a*.

Figure 3:
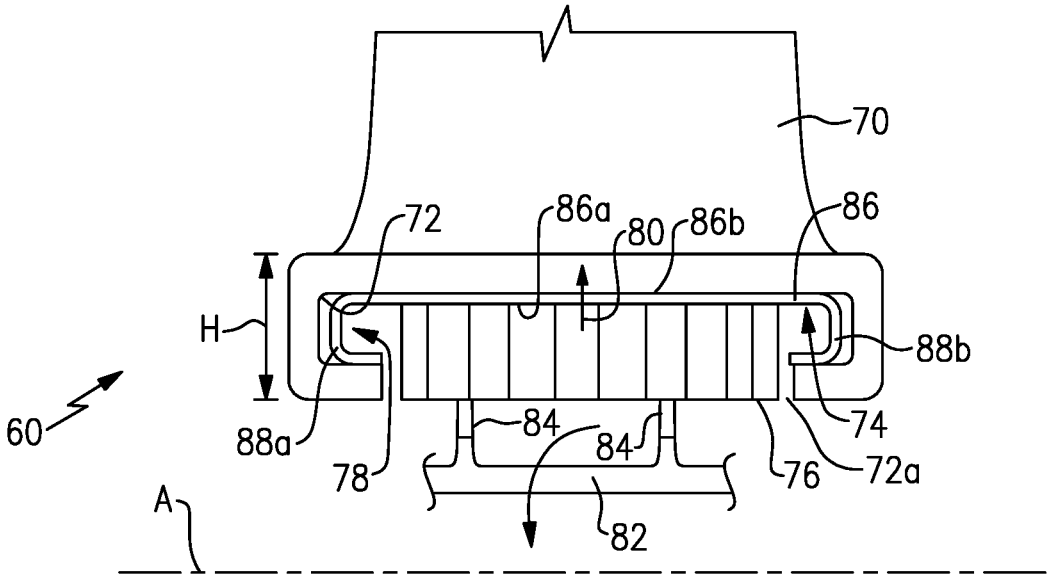
FIG. 3 illustrates the vane seal system according to the section line shown in FIG. 2.

A seal member 74 spans across the gap and extends in the first pocket 68 and the second pocket 72, although the seal member 74 can alternatively be modified for use exclusively in a single pocket. FIG. 3 shows a circumferential view according to the section line in FIG. 2. The seal member 74 includes a seal element 76 and at least one spring portion 78 that is configured to positively locate the seal member 74 in a radial direction 80 in the first pocket 68 and the second pocket 72. The seal element 76, at least in operation of the engine 20, contacts a mating rotatable seal element 82, which in the illustrated example includes a plurality of knife edges 84 that are mounted on a rotor and seal against the seal element 76. The seal element 76 can be a porous element, such as, but not limited to, a honeycomb structure, a porous sintered metal or other porous body. In a modified example, the knife edges 84 could instead be provided on the seal member 74 and the seal element 76 on the rotor.

The seal member 74 also spans between the first and second pockets 68/72. As shown in FIG. 2, the vane segments 62/64 are split at the gap, G, such that the pockets 68/72 can move relative to one another. The opposed ends of the vane segments 62/64, which in this example are radially outward ends represented generally at 83, are rigidly joined by an outer wall 85. The outer wall 85 can be attached to a case structure in a known manner Thus, although the vane segments 62/64 are rigidly secured at the outer ends 83, the inner ends at the pockets 68/72 are permitted to move in response to aerodynamic forces such that the pockets 68/72 can vibrate or otherwise move. By using the seal member 74 that spans between the pockets 68/72, the relative movement can be damped by frictional contact between the seal member 74 and walls of the pockets 68/72. In this regard, the spring portion 78 frictionally contacts the walls of the pockets 68/72. Thus, when the pockets 68/72 move relative to one another, the kinetic energy of the movement is at least partially dissipated through the friction of the spring portion 78 and the production of heat. The geometry of the spring portion 78 can be modified to provide a desired spring force and thus, a desired degree of damping.

The seal member 74 and pockets 68/72 are relatively compact and thus also provide a minimal height, represented at H, between the corresponding airfoil 66 or 70 at the top or radially outer surface of the pockets 68/72 and bottom or radially inward surface of the seal element 76. The reduction in height compared to other types of seal arrangements can also reduce heat that can collect in sealing areas. To achieve the compact arrangement, the seal member 74 includes a base wall 86. The base wall 86 can be made a nickel-based alloy, a titanium-based alloy, an aluminum-based alloy, or iron-based alloy, but is not limited to such alloys. For example, the base wall 86 is a uniform thickness metallic wall having a first side 86*a* and an opposed, second side, 86*b*. In this example, the first side 86*a* is a radially inner side relative to the central engine axis A, and the second side 86*b* is a radially outer side.

The base wall 86 includes a first spring leg 88*a* at one end thereof and a second spring leg 88*b* at an opposed end thereof. The first spring leg 88*a* is oriented at a forward end of the base wall 86 and the second spring leg 88*b* is orientated at the trailing end of the base wall 86. In this example, the spring legs 88*a*/88*b* are C-shaped in cross-section and turn inwards to the interior of the pockets 68/72 to positively locate the seal member 74 in the radial direction. In one modification, the spring legs 88*a*/88*b* turn outwards away from the interior of the pockets 68/72. The radial heights of the spring legs 88*a*/88*b*, with respect to the axis A, are greater than the radial height of the pockets 68/72 such that there is an interference fit between the spring legs 88*a*/88*b* and the walls of the pockets 68/72. The geometry of the spring legs 88*a*/88*b* can be further modified to provide a desired spring force.

Each of the spring legs 88*a*/88*b* extends radially inwardly from the first side 86*a* of the base wall 86. The seal element 76 is rigidly bonded to the base wall 86 between the spring legs 88*a*/88*b* and extends from the first side 86*a*. For example, the seal element 76 is brazed to, welded to, or adhesively bonded to the base wall 86. The seal member 74 is thus a unitary piece that is relatively compact in the height dimension.

Figure 4:
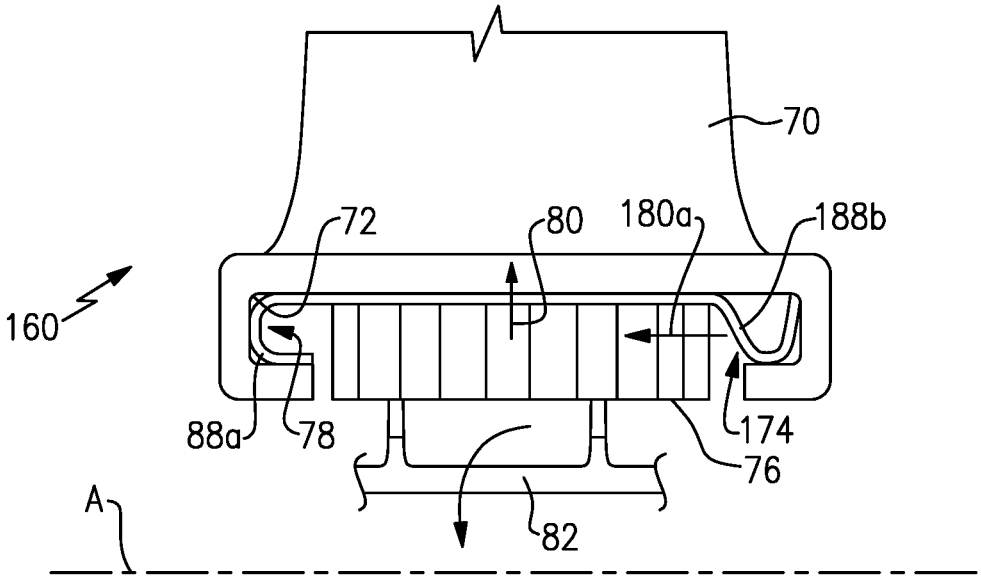
FIG. 4 illustrates another example vane seal system.

FIG. 4 shows a modified example of a vane seal system 160 that has a seal member 174. In this disclosure, like reference numerals designate like elements where appropriate and reference numerals with the addition of one-hundred designate modified elements that are understood to incorporate the same features and benefits of the corresponding elements. In this example, a spring leg 188*b* of a seal member 174 biases the seal element in an axial direction, represented at 180*a*, with respect to the axis A. Thus, the seal member 174 is biased in two different directions, wherein the spring leg 88*a* is configured to positively locate the seal member 174 radially in radial direction 80 and the spring leg 188*b* is configured to bias the seal member 174 in the axial direction 180*a*. The spring leg 188*b* also contacts the walls of the pockets 68/72, as described above, to provide damping.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A seal for a vane seal system, comprising:

a seal member configured to span across a gap between first and second pockets in first and second airfoils of first and second non-rotatable vane segments, respectively, the seal member configured to extend into the first pocket and the second pocket, the seal member having a seal element configured to seal against a mating rotatable seal element and at least one spring portion affixed to the seal element and configured to positively locate the seal element in a sealing direction.

2. A seal as recited in claim 1, wherein the at least one spring portion is rigidly bonded with the seal element.

3. A seal as recited in claim 1, wherein the at least one spring portion includes a first spring portion configured to bias the seal member in a first direction and a second spring portion configured to bias the seal member in a second, different direction.

4. A seal as recited in claim 3, wherein the first direction and the second direction are orthogonal.

5. A seal as recited in claim 1, wherein the at least one spring portion includes a spring leg.

6. A seal as recited in claim 1, wherein the seal member includes a base wall having a first side and a second, opposed side, with a spring leg at one end of the base wall extending from the first side, and the seal element is bonded to the first side.

7. A seal as recited in claim 1, wherein the seal member includes a base wall with a first spring leg at one end thereof and a second spring leg at an opposed end thereof.

8. A seal as recited in claim 7, wherein the first spring leg and the second spring leg bias the seal member in different directions.

9. A seal as recited in claim 1, wherein the at least one spring portion is configured to be in frictional contact with sides of the first pocket and the second pocket such that the at least one spring portion damps relative movement between the first pocket and the second pocket.

10. A seal as recited in claim 1, wherein the seal element includes a porous structure.

11. A seal as recited in claim 1, wherein the seal member includes a uniform thickness base wall and the seal element extends from one side thereof.

12. A seal as recited in claim 1, wherein the first pocket and the second pocket open laterally to each other and have respective open sides opening in a direction away from the respective first airfoil and second airfoil.

13. A method for managing damping in a vane seal system, the method comprising:

damping relative movement between a first pocket at an end of a first airfoil of a first non-rotatable vane segment and a second pocket at an end of a second airfoil of a second non-rotatable vane segment using a seal member that spans across a gap between the first and second pockets, and extends into the first and second pockets and frictionally contacts sides of the first pocket and the second pocket.

14. The method as recited in claim 13, wherein the seal member has a seal element configured to seal against a mating rotatable seal element and at least one spring portion affixed to the seal element and configured to positively locate the seal element in a sealing direction.

15. The method as recited in claim 14, wherein the at least one spring portion is rigidly bonded with the seal element.

16. The method as recited in claim 14, wherein the at least one spring portion includes a first spring portion configured to bias the seal member in a first direction and a second spring portion configured to bias the seal member in a second, different direction.

17. The method as recited in claim 16, wherein the first direction and the second direction are orthogonal.

18. The method as recited in claim 14, wherein the at least one spring portion includes a spring leg.

19. The method as recited in claim 14, wherein the seal member includes a base wall having a first side and a second, opposed side, with a spring leg at one end of the base wall extending from the first side, and the seal element is bonded to the first side.

20. The method as recited in claim 13, wherein the seal member includes a base wall with a first spring leg at one end thereof and a second spring leg at an opposed end thereof, and wherein the first spring leg and the second spring leg bias the seal member in different directions.

* * * * *